US007257973B2

(12) United States Patent
Romero et al.

(10) Patent No.: US 7,257,973 B2
(45) Date of Patent: Aug. 21, 2007

(54) CHASSIS FOR A LOCK SET

(75) Inventors: Oscar Romero, Lake Forest, CA (US); Jeanette Vy Bui, Irvine, CA (US); Graham John Wheatland, Rancho Santa Margarita, CA (US)

(73) Assignee: Newfrey, LLC, Newark, DE (US)

( * ) Notice: Subject to any disclaimer, the term of this patent is extended or adjusted under 35 U.S.C. 154(b) by 150 days.

(21) Appl. No.: 11/196,175

(22) Filed: Aug. 3, 2005

(65) Prior Publication Data

US 2005/0262906 A1 Dec. 1, 2005

Related U.S. Application Data

(63) Continuation-in-part of application No. 10/780,189, filed on Feb. 17, 2004, now abandoned.

(51) Int. Cl.
*E05B 3/00* (2006.01)

(52) U.S. Cl. ..... 70/107; 70/224; 292/336.3

(58) Field of Classification Search ..... 70/107, 70/118, 210–211, 224, 417, 451–452; 292/33–37, 292/21, 40, 336.3
See application file for complete search history.

(56) References Cited

U.S. PATENT DOCUMENTS

| | | | | |
|---|---|---|---|---|
| 1,723,665 A | | 8/1929 | Thomas | |
| 3,097,007 A | * | 7/1963 | Eichacker et al. | 70/92 |
| 3,791,180 A | | 2/1974 | Doyle | 70/107 |
| 3,881,331 A | | 5/1975 | Tranberg et al. | 70/107 |
| 3,910,613 A | | 10/1975 | Nolin | 292/34 |
| 3,990,277 A | | 11/1976 | Mullich | 70/107 |
| 3,999,789 A | | 12/1976 | Maurits et al. | 292/34 |
| 4,129,019 A | | 12/1978 | Urdal | 70/107 |
| 4,156,541 A | | 5/1979 | Babb, Jr. et al. | 292/21 |
| 4,183,563 A | | 1/1980 | Stevens | 292/34 |
| 4,276,760 A | | 7/1981 | Nolin | 70/107 |
| 4,345,449 A | | 8/1982 | Mullich | 70/153 |
| 4,418,552 A | | 12/1983 | Nolin | 70/107 |
| 4,709,565 A | | 12/1987 | Lin | 70/107 |
| 4,838,053 A | | 6/1989 | Shen | 70/92 |
| 4,915,432 A | | 4/1990 | Gressett, Jr. | 292/336.3 |
| 4,934,800 A | | 6/1990 | Choi | 292/172 |
| 4,979,767 A | | 12/1990 | Lin | 292/336.3 |

(Continued)

*Primary Examiner*—Suzanne Dino Barrett
*Assistant Examiner*—Christopher Boswell
(74) *Attorney, Agent, or Firm*—Richard J. Veltman, Esq.; Taylor & Aust, P.C.; Ronald K. Aust, Esq.

(57) ABSTRACT

An interconnected chassis includes a mounting plate including a spring engaging tab. A cover plate includes a recessed spring retention wall. A lower cam has a lower pivot axis. An upper cam has an upper pivot axis. A slide plate is positioned between the mounting plate and the cover plate, the slide plate having a spring retention slot and a spring support ledge. The slide plate includes a first end having a pivot feature and a second end having a lower cam engagement member for engaging the lower cam. A spring is positioned in the spring retention slot of the slide plate and in the recessed spring retention wall of the cover plate, and between the spring engaging tab of the mounting plate and the spring support ledge of the slide plate. A toggle is pivotably coupled to the slide plate by the pivot feature, the toggle having a head portion positioned to engage the upper cam.

18 Claims, 10 Drawing Sheets

U.S. PATENT DOCUMENTS

| | | | | |
|---|---|---|---|---|
| 4,982,986 | A | 1/1991 | Gressett, Jr. et al. | 292/336.3 |
| 4,988,136 | A | 1/1991 | Gressett, Jr. | 292/336.3 |
| 5,077,992 | A | 1/1992 | Su | 70/107 |
| 5,205,596 | A | 4/1993 | Ralph | 292/336.3 |
| 5,325,687 | A | 7/1994 | Lin | 70/107 |
| 5,445,423 | A | 8/1995 | Mader | 292/336.3 |
| 5,492,380 | A | 2/1996 | Smallegan et al. | 292/336.3 |
| 5,496,082 | A | 3/1996 | Zuckerman | 292/336.3 |
| 5,513,505 | A | 5/1996 | Dancs | 70/107 |
| 5,544,507 | A | 8/1996 | Lin | 70/107 |
| 5,611,227 | A * | 3/1997 | Solovieff | 70/218 |
| 5,657,653 | A | 8/1997 | Hensley et al. | 70/224 |
| 5,658,026 | A * | 8/1997 | Nigro et al. | 292/336.3 |
| 5,664,816 | A | 9/1997 | Nigro, Jr. et al. | 292/336.3 |
| 5,713,612 | A | 2/1998 | Kajuch | 292/36 |
| 5,809,812 | A | 9/1998 | Gallego | 70/107 |
| 5,881,585 | A | 3/1999 | Kang | 70/107 |
| 5,881,586 | A | 3/1999 | Shen | 70/107 |
| 6,170,305 | B1 | 1/2001 | Shen | 70/107 |
| 6,491,327 | B1 | 12/2002 | Fan | 292/165 |
| 6,564,596 | B2 | 5/2003 | Huang | 70/107 |
| 6,581,426 | B2 | 6/2003 | Bates et al. | 70/278.7 |
| 6,584,818 | B2 | 7/2003 | Bates et al. | 70/432 |
| 6,615,629 | B2 | 9/2003 | Bates et al. | 70/434 |
| 2003/0033839 | A1 | 2/2003 | Chen et al. | 70/107 |
| 2004/0107747 | A1* | 6/2004 | Chang | 70/107 |

* cited by examiner

CHASSIS FOR A LOCK SET

This application is a continuation-in-part of U.S. patent application Ser. No. 10/780,189 filed Feb. 17, 2004, now abandoned and entitled "INTERCONNECTED CHASSIS FOR A LOCK SET".

BACKGROUND OF THE INVENTION

1. Field of the Invention

The present invention relates to door hardware, and, more particularly, to an interconnected chassis for a lock set.

2. Description of the Related Art

Lock sets have long been available that include an interconnected lock assembly, wherein actuation of an interior operator, e.g., knob or lever, simultaneously retracts both a latch bolt and a dead bolt. Such a lock assembly may be found in both commercial and residential environments. In one such lock set, a series of gears, e.g., a rack, is used to effect the simultaneous operation.

In another such lock set, for example, a slide is positioned between the actuation mechanism of the operator and the actuation mechanism of a turn piece connected to the dead bolt, wherein the slide may be spring biased in a plane of travel of the slide. Assembly of such a lock set, however, may be complicated by including chassis components that are riveted together.

Furthermore, some lock sets may be limited by their configuration to a particular escutcheon and/or operator, and thus, limit a customer to a particular escutcheon design and/or operator type.

What is needed in the art is an interconnected chassis for a lock set that addresses the above-identified problems.

SUMMARY OF THE INVENTION

The invention, in one form thereof, is directed to an interconnected chassis for a lock set. The interconnected chassis includes a mounting plate including a spring engaging tab. A cover plate includes a recessed spring retention wall. A lower cam has a lower pivot axis that passes through the mounting plate and the cover plate. An upper cam has an upper pivot axis that passes through the mounting plate and the cover plate. A slide plate is positioned between the mounting plate and the cover plate, the slide plate having a spring retention slot and a spring support ledge. The slide plate includes a first end having a pivot feature and a second end having a lower cam engagement member for engaging the lower cam. A spring is positioned in the spring retention slot of the slide plate and in the recessed spring retention wall of the cover plate, and between the spring engaging tab of the mounting plate and the spring support ledge of the slide plate. A toggle is pivotably coupled to the slide plate by the pivot feature, the toggle having a head portion positioned to engage the upper cam.

In another form thereof, the invention is directed to an interconnected chassis for a lock set. The interconnected chassis includes a mounting plate including a first spring engaging tab and a second spring engaging tab. A cover plate includes a first recessed spring retention wall and a second recessed spring retention wall. A lower cam has a lower pivot axis that passes through the mounting plate and the cover plate. An upper cam has an upper pivot axis that passes through the mounting plate and the cover plate. A slide plate is positioned between the mounting plate and the cover plate. The slide plate has a first spring retention slot, a second spring retention slot, a first spring support ledge and a second spring support ledge. The slide plate includes a first end having a pivot feature and a second end having at least one lower cam engagement member for engaging the lower cam. A first spring is positioned in the first spring retention slot of the slide plate and in the first recessed spring retention wall of the cover plate, and is positioned between the first spring engaging tab of the mounting plate and the first spring support ledge of the slide plate. A second spring is positioned in the second spring retention slot of the slide plate and in the second recessed spring retention wall of the cover plate, and is positioned between the second spring engaging tab of the mounting plate and the second spring support ledge of the slide plate. A toggle is pivotably coupled to the slide plate by the pivot feature, the toggle having a head portion positioned to engage the upper cam.

In another form thereof, the invention is directed to a method for providing a lock set with an interconnected chassis. The method includes the steps of configuring a mounting plate for attachment to a door, the mounting plate having a spring engaging tab; configuring a cover plate including a recessed spring retention wall; associating a first cam, having a first pivot axis, with the mounting plate and the cover plate; associating a second cam, having a second pivot axis, with the mounting plate and the cover plate, the first cam and the second cam being spaced apart; positioning a slide plate between the mounting plate and the cover plate, the slide plate having a spring retention slot and a spring support ledge, the slide plate including a first end having a pivot feature and a second end having a lower cam engaging member for engaging the lower cam; positioning a compression spring in the spring retention slot of the slide plate and in the recessed spring retention wall of the cover plate, and between the spring engaging tab of the mounting plate and the spring support ledge of the slide plate; and pivotably coupling a toggle to the slide plate by the pivot feature, the toggle having a head portion positioned to engage the upper cam.

In another form thereof, the invention is directed to a method for operating a lock set, including rotating an operator by a first amount to move a dead bolt from a fully extended position to a fully retracted position, and to move a latch bolt from a fully extended position to a partially retracted position.

An advantage of the present invention is that the interconnected chassis is relatively simple to assemble.

Another advantage is that the present invention is configured to reduce the chance of unintended lateral spring displacement during operation.

Another advantage of the present invention is that the interconnected chassis can reduce the effects of door hardware misalignment.

Yet another advantage is that the interconnected chassis of the present invention is independent of the escutcheon and/or interior operator, and therefore can accommodate a variety of decorative escutcheons of various materials and ornamental features, and/or a variety of interior operator types.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
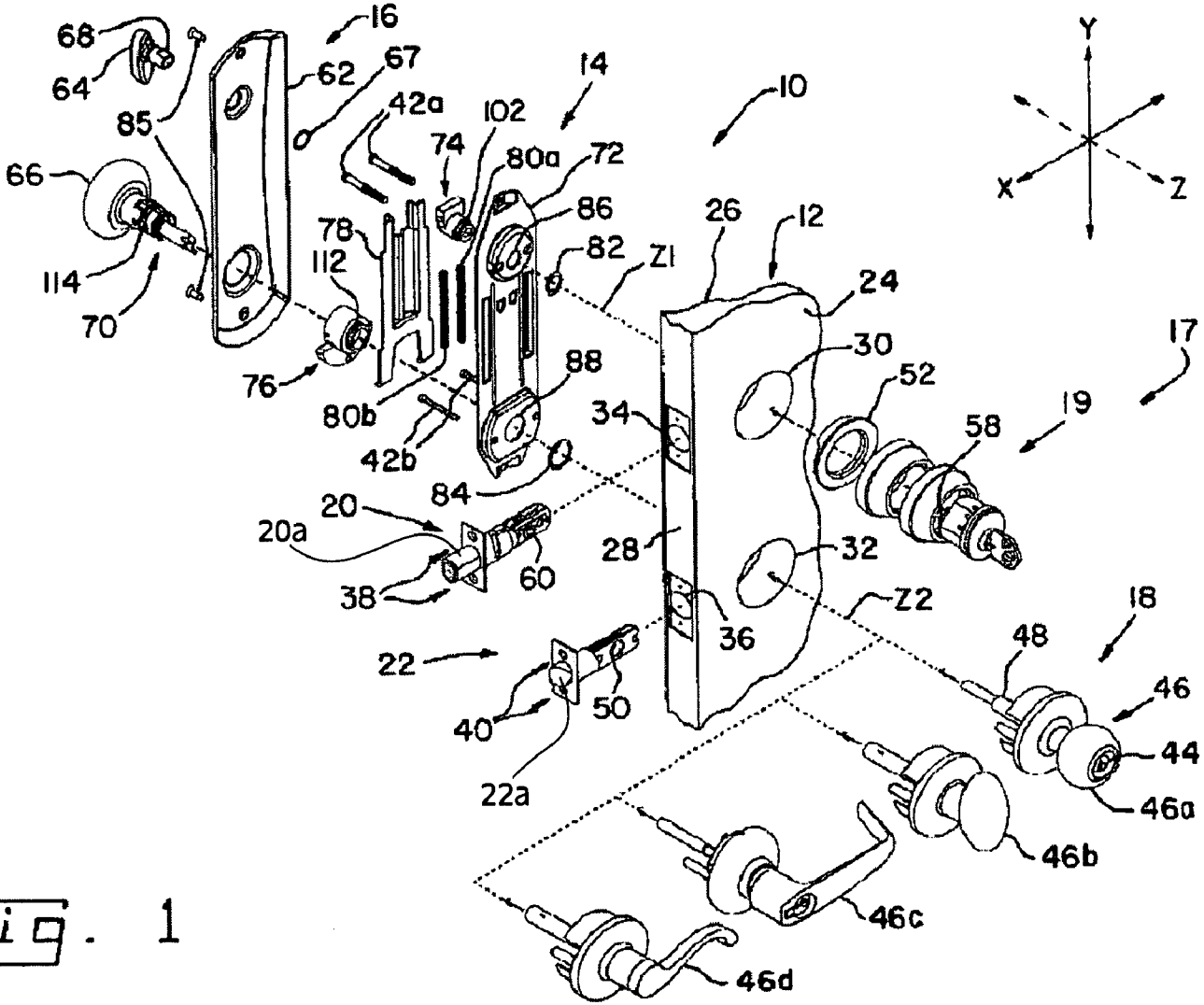
FIG. 1 is an exploded perspective view of an interconnected lock set embodying the present invention.

Referring now to the drawings, and more particularly to FIG. 1, there is shown a lock set 10 embodying the present invention, for mounting to a door 12. Lock set 10 includes, for example, an interconnected chassis 14; an interior operating unit 16; an exterior operating unit 17, including an exterior operator 18 and a dead bolt lock assembly 19; a dead bolt assembly 20; and a latch bolt assembly 22.

Door 12 includes an exterior side 24, an interior side 26, and an end 28. An upper bore 30 and a lower bore 32 are formed through door 12 from exterior side 24 to interior side 26. A dead bolt bore 34 is formed in door 12 from end 28 to upper bore 30. A latch bolt bore 36 is formed in door 12 from end 28 to lower bore 32.

During assembly, interconnected chassis 14 is positioned adjacent interior side 26 of door 12, and is interposed between interior operating unit 16 and exterior operating unit 17. Dead bolt assembly 20 is inserted into dead bolt bore 34 and attached to end 28 with two fasteners 38. Latch bolt assembly 22 is inserted into latch bolt bore 36 and attached to end 28 with two fasteners 40. Interconnected chassis 14 is attached to interior side 26 of door 12 with two fasteners 42*a*, which engage corresponding threaded holes in dead bolt lock assembly 19, and with two fasteners 42*b* which engage corresponding threaded holes in exterior operator 18.

FIG. 1 shows four exemplary configurations for exterior operator 18. Exterior operator 18 may include an operator lock assembly 44, and includes an exterior handle 46. Exterior handle 46 may be, for example, in a form having a knob, such as one of knobs 46*a*, 46*b*, or in a form having a lever, such as one of levers 46*c*, 46*d*.

Exterior operator 18 includes a drive portion 48, such as a half-round spindle. Drive portion 48 is inserted into lower bore 32 to engage a driven member 50 of latch bolt assembly 22.

Dead bolt lock assembly 19 includes a bushing 52 that is inserted into upper bore 30 from exterior side 24. Dead bolt lock assembly 19 further includes a drive member 58, which is inserted into bushing 52 and upper bore 30 to engage a driven member 60 of dead bolt assembly 20, and engages interconnected chassis 14 in a manner discussed in further detail below.

Interior operating unit 16 includes an interior escutcheon 62, a turn piece 64, and an interior operator 66. Turn piece 64 includes a drive member 68 that engages drive member 58 of dead bolt lock assembly 19, and engages interconnected chassis 14. Turn piece 64 is rotatably coupled to interior escutcheon 62 via a snap ring 67. Interior operator 66 includes a drive portion 70, such as a split half-round spindle. Split half-round spindle 70 is permanently assembled into interior operator 66, and does not engage with half-round spindle 48 of exterior operator 18. Interior operator 66 further includes, however, a mounting portion 114, which engages interior drivers in lower cam 76.

Figure 2:
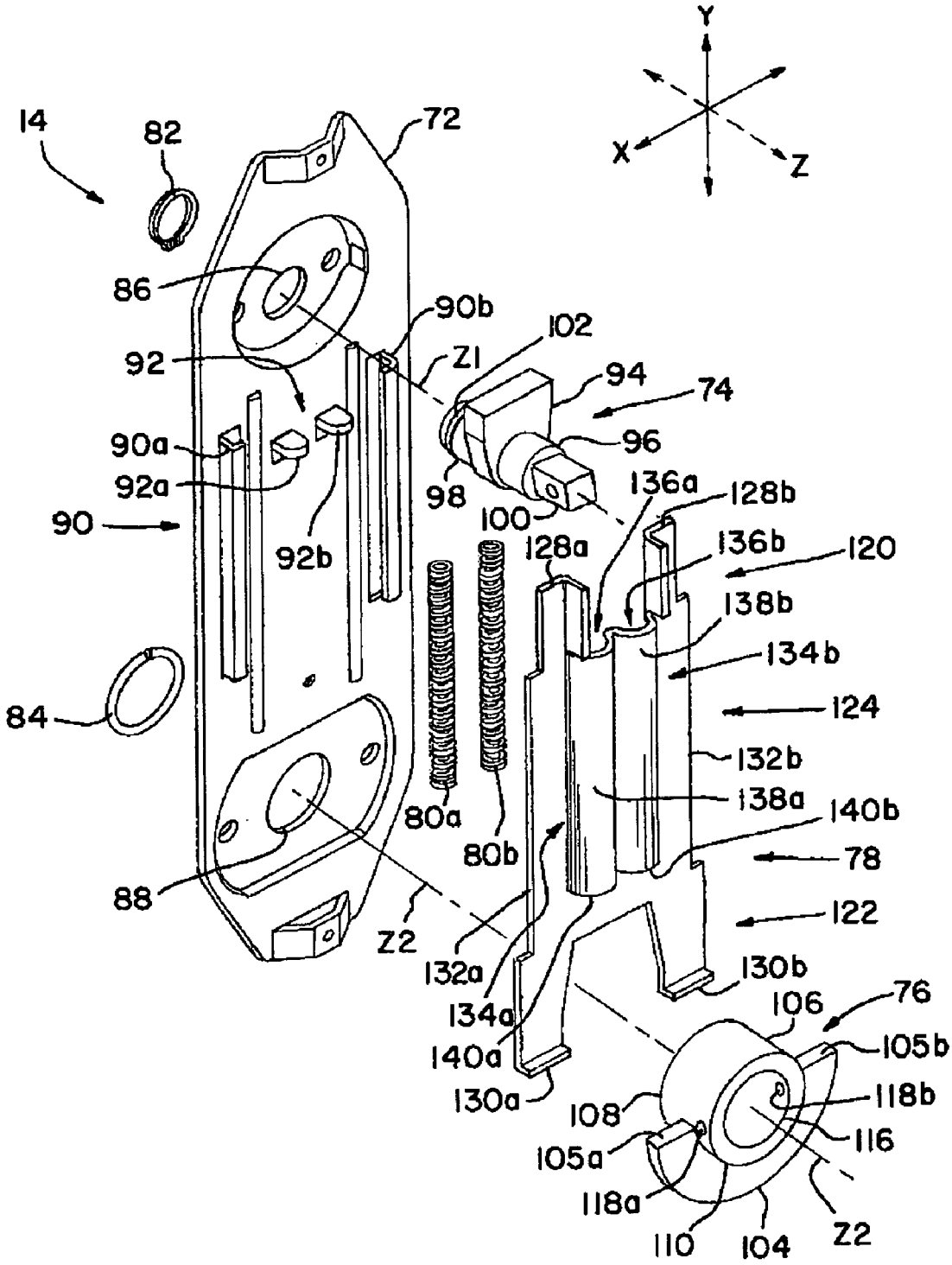
FIG. 2 is an exploded perspective view of the interconnected chassis embodied in FIG. 1.

Referring now also to FIG. 2, interconnected chassis 14 is an assembly that includes a mounting plate 72, an upper cam arm 74, a lower cam arm 76, a slide plate 78, two springs 80*a* and 80*b*, a retaining ring 82 and a retaining ring 84. Interior escutcheon 62 covers interconnected chassis 14, and is mounted to door 12 via fasteners 85 that engage holes in mounting plate 72 (see FIG. 1).

Mounting plate 72 includes an upper opening 86; a lower opening 88 vertically spaced apart from upper opening 86 in direction Y; a pair of guide channels 90, individually referenced as 90*a* and 90*b*, and horizontally spaced apart in direction X; and a pair of spring engaging members 92, individually referenced as 92*a* and 92*b*, and horizontally spaced apart in direction X.

Upper cam arm 74 includes a cam lobe 94, and an axial shaft 96 having a first end portion 98 and a second end portion 100, with cam lobe 94 being fixed to axial shaft 96 between first end portion 98 and second end portion 100. First end portion 98 includes a snap-ring groove 102. During assembly, first end portion 98 is inserted through upper opening 86 of mounting plate 72, and is rotatably supported thereby. Retaining ring 82 in inserted into snap-ring groove 102 to retain upper cam arm 74 in rotatable attachment with, i.e., is rotatably coupled to, mounting plate 72. Upon final attachment of interconnected chassis 14 to door 12, second end portion 100 is connected to drive member 68 of turn piece 64, and first end portion 98 is connected to drive member 58 of dead bolt lock assembly 19. Thus, upper cam arm 74 may be rotated about its rotational axis Z1 by a corresponding rotation of either of drive member 68 of turn piece 64 or drive member 58 of dead bolt lock assembly 19.

Lower cam arm 76 includes a cam lobe 104 having cam surfaces 105*a* and 105*b*, and a hollow axial shaft 106 having a first end portion 108 and a second end portion 110, with cam lobe 104 being fixed to hollow axial shaft 106 between first end portion 108 and second end portion 110. First end portion 108 includes a snap-ring groove 112 (see FIG. 1). During assembly, first end portion 108 is inserted through lower opening 88 of mounting plate 72, and is rotatably supported thereby. Retaining ring 84 in inserted into snap-ring groove 112 to retain lower cam arm 76 in rotatable attachment with, i.e., is rotatably coupled to, mounting plate 72. Upon final attachment of interconnected chassis 14 to door 12, mounting portion 114 of interior operator 66 is received in an opening 116 of hollow axial shaft 106, and is attached and secured thereto by set screws 118*a*, 118*b*. The configuration of exterior operator 18 and interior operator 66 is such that lower cam arm 76 can be rotated about its rotational axis Z2 by a corresponding rotation of interior operator 66, but lower cam arm 76 is not operable by drive portion 48 of exterior handle 46 of exterior operator 18.

Slide plate 78 has a first end 120, a second end 122, and an interior region 124 located between first end 120 and second end 122. A pair of upper cam arm engagement members 128*a*, 128*b* is located at first end 120 of slide plate 78. A pair of lower cam arm engagement members 130*a*, 130*b* is located at second end 122 of slide plate 78.

Interior region 124 includes a pair of guide rails 132*a*, 132*b* that are horizontally spaced, i.e., spaced in the X direction, and vertically extending, i.e., extending in the Y direction. In addition, interior region 124 includes a pair of horizontally spaced, and vertically extending, spring retention housings 134*a*, 134*b*. Spring retention housing 134*a* includes an elongated cavity 136*a* defined by a spring retention wall 138*a*, and has a spring engaging surface 140*a*. Spring retention housing 134*b* includes an elongated cavity 136*b* defined by a spring retention wall 138*b*, and has a spring engaging surface 140*b*.

During assembly of interconnected chassis 14, slide plate 78 is positioned between guide channels 90*a*, 90*b* of mounting plate 72, such that guide rails 132*a*, 132*b* are in respective sliding engagement with guide channels 90*a*, 90*b*.

Figure 3A:
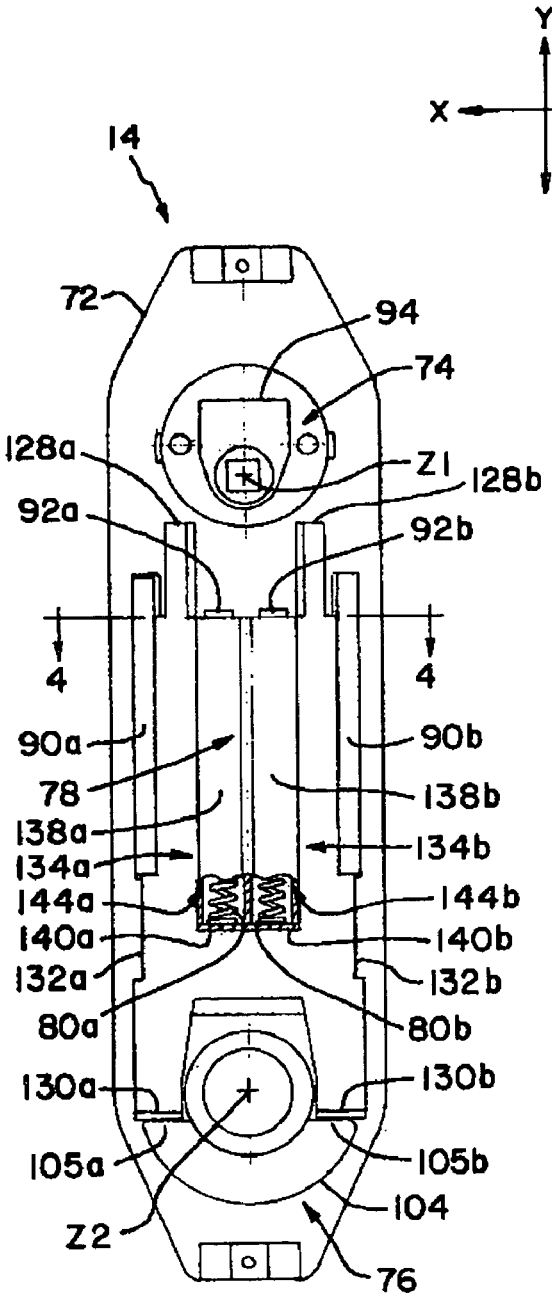
FIG. 3A is a front view of the interconnected chassis of FIG. 2 with the slide plate and the lower cam arm in a rest position, and with the upper cam arm in an unlocked position, with a portion of the spring retention housings broken away to show the corresponding springs.
Figure 3B:
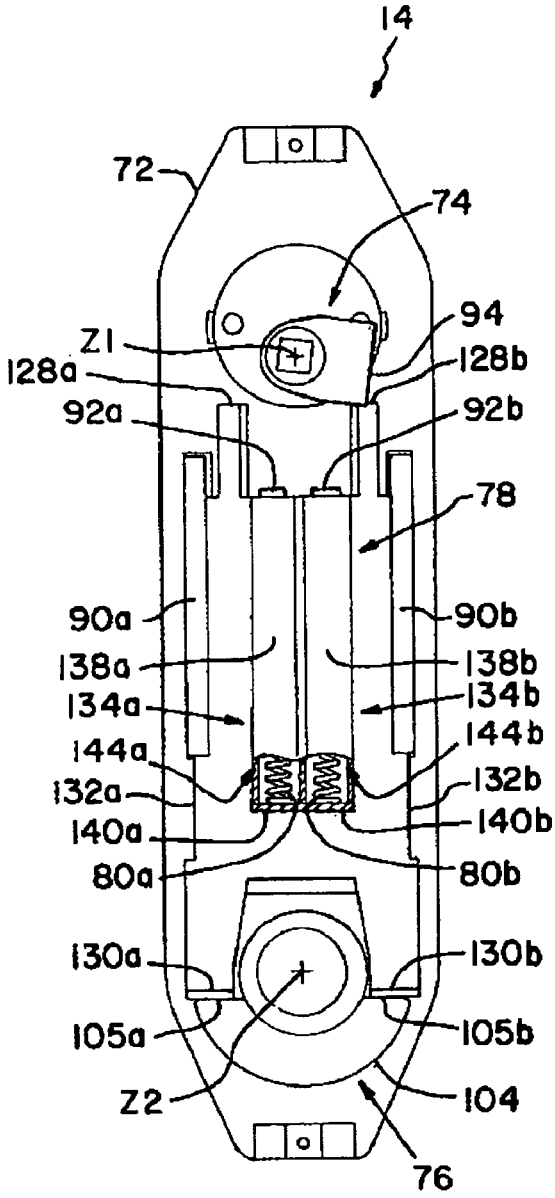
FIG. 3B is a front view of the interconnected chassis of FIG. 2 with the upper cam arm in a locked position, with a portion of the spring retention housings broken away to show the corresponding springs.
Figure 3C:
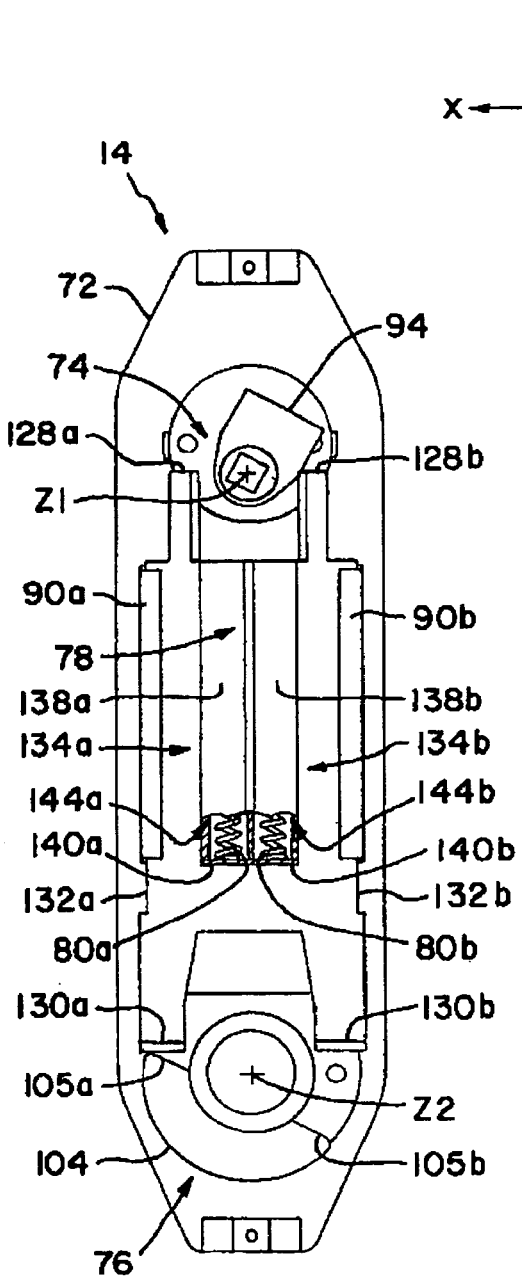
FIG. 3C is a front view of the interconnected chassis of FIG. 2, wherein a rotation of the lower cam arm causes the slide plate to engage and rotate the upper cam arm from the locked position toward an unlocked position, with a portion of the spring retention housings broken away to show the corresponding springs.
Figure 3D:
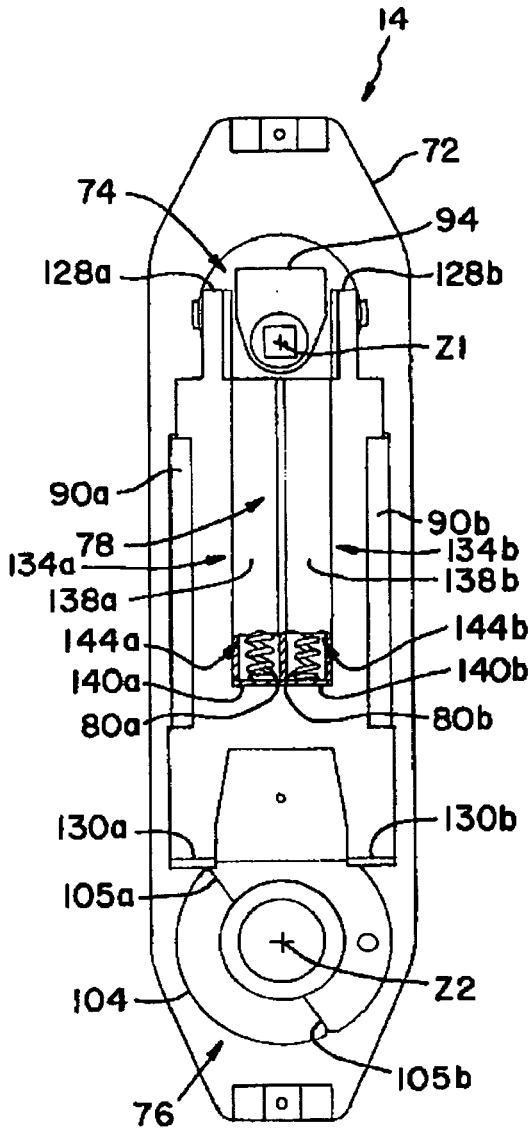
FIG. 3D is a front view of the interconnected chassis of FIG. 2 with the slide plate having rotated the upper cam arm to the unlocked position, with a portion of the spring retention housings broken away to show the corresponding springs.
Figure 4:
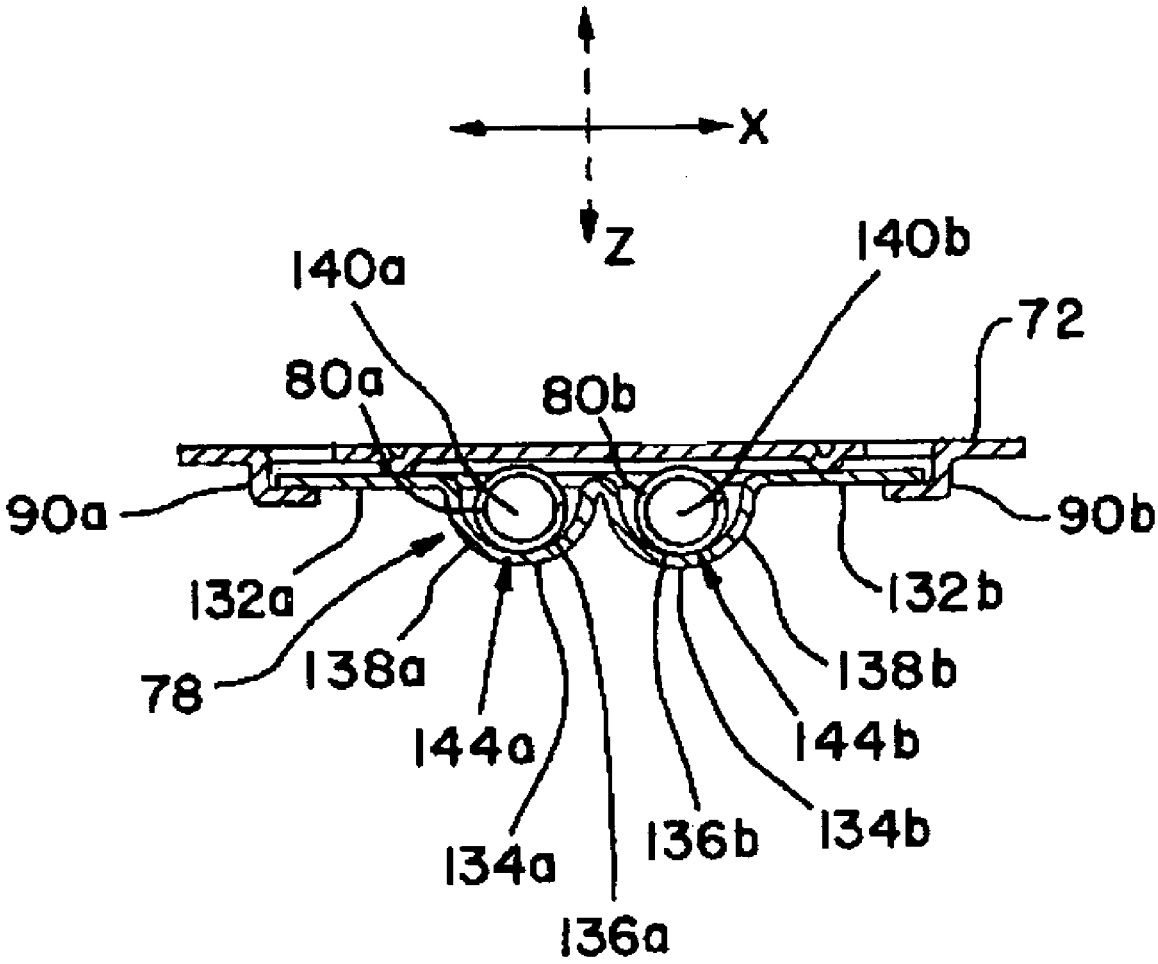
FIG. 4 is a cross-sectional view of the interconnect chassis taken along line 4-4 of FIG. 3A.

Referring to FIGS. 1, 3A and 4, elongated cavity 136*a* defined by spring retention wall 138*a* of slide plate 78 cooperates with mounting plate 72 to define an elongated spring retention chamber 144*a* that provides lateral containment and lateral support of compression spring 80*a*, e.g., in the plane of directions X and Z. Compression spring 80*a* is positioned in the elongated spring retention chamber 144*a*, and the longitudinal ends of compression spring 80*a* are positioned between spring engaging member 92*a* of mounting plate 72 and spring engaging surface 140*a* of spring retention housing 134*a* of slide plate 78, which thereby provide longitudinal retention of compression spring 80*a*, e.g., in direction Y. As shown in FIGS. 3A-3D, the longitudinal extent of compression spring 80*a* is covered by the elongated spring retention chamber 144*a*, although a portion of spring retention housing 134*a* is shown broken away to show the containment of spring 80*a*.

Also, elongated cavity 136*b* defined by spring retention wall 138*b* of slide plate 78 cooperates with mounting plate 72 to define an elongated spring retention chamber 144*b* that provides lateral containment and lateral support of compression spring 80*b*, e.g., in the plane of directions X and Z. Compression spring 80*b* is positioned in the elongated spring retention chamber 144*b*, and the longitudinal ends of compression spring 80*b* are positioned between spring engaging member 92*b* of mounting plate 72 and spring engaging surface 140*b* of spring retention housing 134*b* of slide plate 78, which thereby provide longitudinal retention of compression spring 80*b*, e.g., in direction Y. As shown in FIGS. 3A-3D, the longitudinal extent of compression spring 80*b* is covered by the elongated spring retention chamber 144*b*, although a portion of spring retention housing 134*b* is shown broken away to show the containment of spring 80*b*.

FIG. 3A is front view of interconnected chassis 14 with each of slide plate 78 and lower cam arm 76 in a rest position, and with upper cam arm 74, and correspondingly turn piece 64, in an unlocked position. The unlocked position corresponds to a position wherein the dead bolt of dead bolt assembly 20 (see FIG. 1) is retracted. With this arrangement, each of compression springs 80*a*, 80*b* bias lower cam arm engagement members 130*a*, 130*b* of slide plate 78 into engagement with cam surfaces 105*a*, 105*b* of lower cam arm 76, thus defining the respective rest positions for lower cam arm 76 and slide plate 78, when no rotational force is applied to interior operator 66 (see also FIG. 1).

FIG. 3B is a front view of interconnected chassis 14 with upper cam arm 74 in a locked position, which occurs, for example, when either turn piece 64 or drive member 58 of dead bolt lock assembly 19 is rotated approximately 90 degrees. The locked position corresponds to a position wherein the dead bolt of dead bolt assembly 20 (see FIG. 1) is extended to engage the strike of the door frame (not shown). With this arrangement, each of compression springs 80*a*, 80*b* continue to bias lower cam arm engagement members 130*a*, 130*b* of slide plate 78 into engagement with cam surfaces 105*a*, 105*b* of lower cam arm 76.

FIG. 3C is a front view of interconnected chassis 14, wherein a rotation of lower cam arm 76 causes slide plate 78 to engage and rotate the upper cam arm 74 from the locked position (see FIG. 3B) toward the unlocked position (see FIG. 3A). More specifically, also referring to FIG. 1, a counterclockwise rotation of interior operator 66 about rotational axis Z2 results in a corresponding rotation of lower cam arm 76, which in turn causes a vertical displacement of slide plate 78 in direction Y, with cam lobe 104 of lower cam arm 76 lifting slide plate 78 via continuing engagement of cam surface 105*a* with lower cam arm engagement member 130*a* of slide plate 78. In turn, upper cam arm engagement member 128*b* engages cam lobe 94 of upper cam arm 74, resulting in a rotation of upper cam arm 74 about rotational axis Z1. Likewise, a clockwise rotation of interior operator 66 about rotational axis Z2 results in a corresponding rotation of lower cam arm 76, which in turn causes a vertical displacement of slide plate 78 in direction Y, with cam lobe 104 of lower cam arm 76 lifting slide plate 78 via continuing engagement of cam surface 105*b* with lower cam arm engagement member 130*b* of slide plate 78. In turn, upper cam arm engagement member 128*b* engages cam lobe 94 of upper cam arm 74, resulting in a rotation of upper cam arm 74 about rotational axis Z1.

FIG. 3D is a front view of interconnected chassis 14 with slide plate 78 having rotated upper cam arm 74 to the unlocked position, as a continuation of the operation described above with respect to FIG. 3C. The unlocked position of FIG. 3D is achieved from the locked position of FIG. 3B when lower cam arm 76 has rotated approximately 45 degrees, via the corresponding driving rotation of interior operator 66.

When the rotational force is removed from interior operator 66, each of slide plate 78 and lower cam arm 76 return to the rest position as shown in FIG. 3A, and upper cam arm 74, and correspondingly turn piece 64, remain in the unlocked position.

Figure 5:
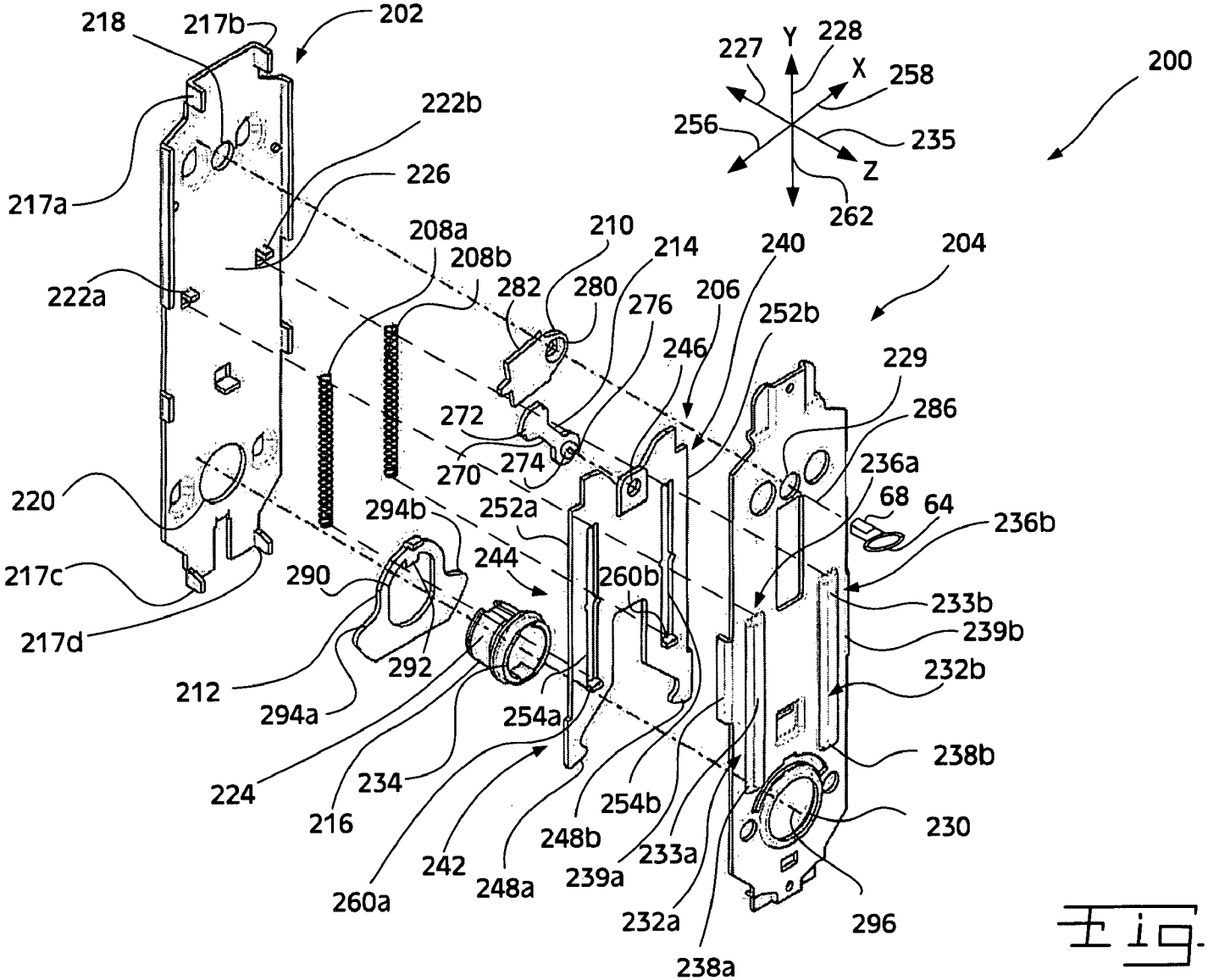
FIG. 5 is an exploded perspective view of a chassis assembly in accordance with another embodiment of the present invention.
Figure 6:
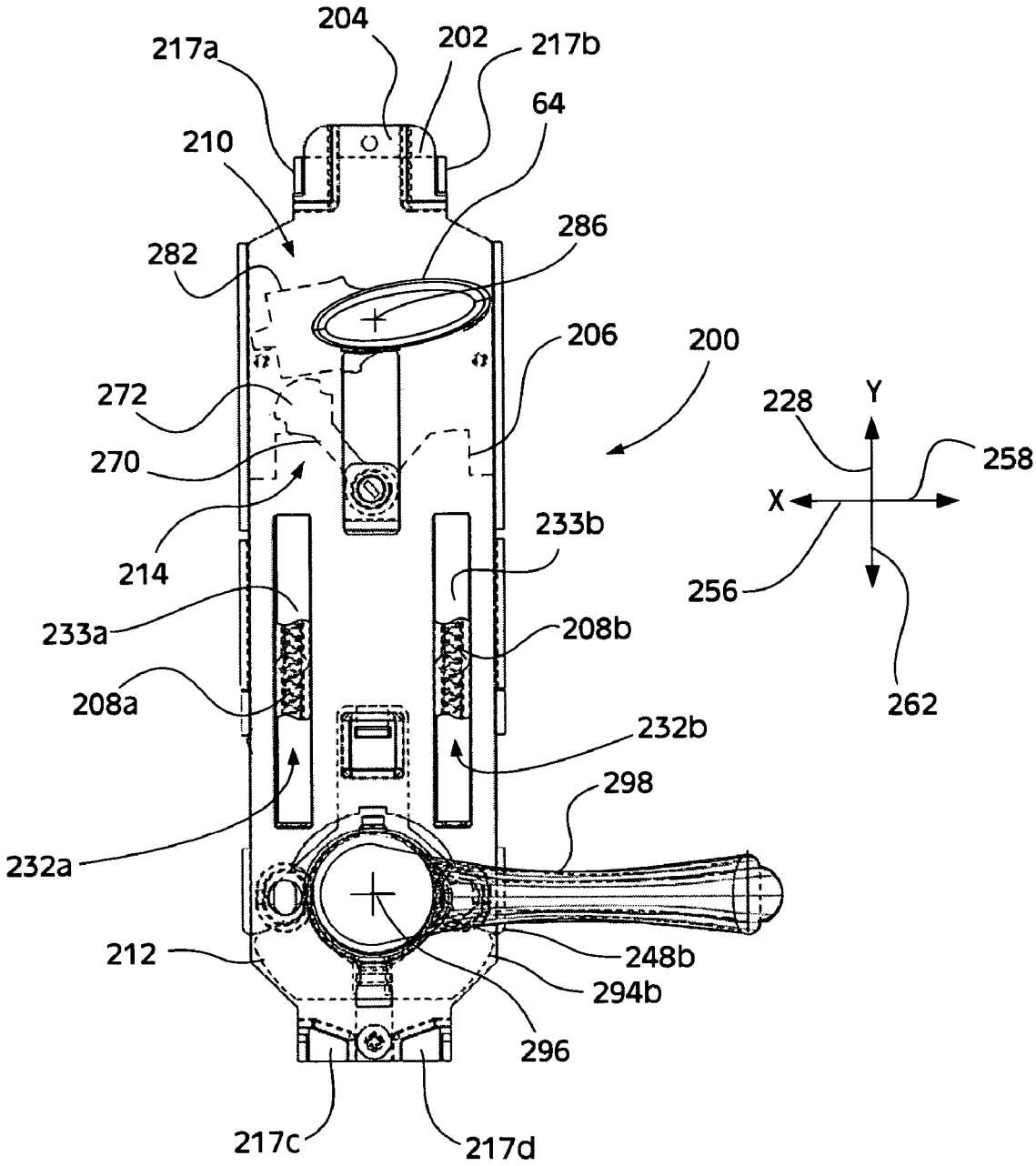
FIG. 6 is a front view of the chassis assembly of FIG. 5 in an assembled state, with some components shown by phantom lines, and with a portion of the cover plate broken away to expose the springs.

FIGS. 5 and 6 are directed to another embodiment of the present invention.

Referring to FIG. 5, there is shown an exploded perspective view of a chassis assembly 200. Chassis assembly 200 includes a mounting plate 202, a cover plate 204, a slide plate 206, springs 208*a* and 208*b*, an upper cam 210, a lower cam 212, a toggle 214 and a hub 216. Springs 208*a*, 208*b* may be, for example, coil springs, i.e., compression springs.

Mounting plate 202 includes assembly tabs 217*a*, 217*b*, 217*c* and 217*d*, an upper opening 218, a lower opening 220, and upper spring engaging tabs 222*a* and 222*b*. Upper opening 218 is sized to receive drive member 68 of turn piece 64. Lower opening 220 is sized to receive a sleeve portion 224 of hub 216. A plate surface 226 of mounting plate 202 serves to restrain lateral motion of springs 208*a*, 208*b* in direction 227. Spring engaging tabs 222*a* and 222*b* restrain springs 208*a* and 208*b* from upward movement in direction 228.

Cover plate 204 includes an upper opening 229, a lower opening 230, and spring retainer channels 232*a* and 232*b*. Upper opening 229 is sized to receive drive member 68 of turn piece 64. Lower opening 230 is sized to receive a lip portion 234 of hub 216. Spring retainer channels 232*a* and 232*b* are formed as concave recessed regions, e.g., elongated cavities, in cover plate 204 defined by recessed concave walls 233*a* and 233*b*, which restrain lateral motion of springs 208*a*, 208*b* in direction 235. Spring retainer channels 232*a* and 232*b* respectively include upper ends 236*a* and 236*b*, where tabs 222*a* and 222*b* of mounting plate 202 are received, respectively. Spring retainer channels 232*a* and 232*b* also respectively include lower ends 238*a* and 238*b*. Cover plate 204 further includes a pair of slide plate retention walls 239*a* and 239*b* that are horizontally spaced along the X axis, and which provide guide surfaces for slide plate 206 parallel to the Y axis.

Slide plate 206 has a first end 240, a second end 242, and an interior region 244 located between first end 240 and second end 242. Located at first end 240 of slide plate 206 is a pivot hole 246. A pair of lower cam arm engagement members 248*a* and 248*b* is located at second end 242 of slide plate 206.

Slide plate 206 includes a pair of guide rails 252*a*, 252*b* that are horizontally spaced, i.e., spaced in the X axis directions, and vertically extending, i.e., extending in the Y axis directions. Guide rails 252*a*, 252*b* are positioned between slide plate retention walls 239*a* and 239*b* of cover plate 204. Interior region 244 includes a pair of horizontally spaced, and vertically extending, spring retention slots 254*a* and 254*b*. Spring retention slots 254*a* and 254*b* restrain movement of springs 208*a*, 208*b* in directions 256 and 258, i.e., in the X axis directions. Located at a lower extreme of each of spring retention slots 254*a* and 254*b* is a spring support ledge 260*a* and 260*b*, respectively, for restraining springs 208*a* and 208*b* in direction 262 along the Y axis.

Toggle 214 includes an elongate portion 270, a head portion 272 and a pivot shaft 274 having a pivot axis 276. Pivot shaft 274 is received in pivot hole 246 of slide plate 206, such that pivot axis 276 passes through the center of pivot hole 246. Accordingly, toggle 214 pivots about pivot axis 276 at first end 240 of slide plate 206.

Upper cam 210 includes a keyed opening 280 and a cam arm 282. Keyed opening 280 includes a pair of flat sides that are sized and positioned to engage corresponding flats on drive member 68 of turn piece 64, such that when drive member 68 is inserted into keyed opening 280, turn piece 64 and upper cam 210 will pivot as a unit about a pivot axis 286, which in turn passes through each of upper opening 218 of mounting plate 202 and upper opening 229 of cover plate 204. Upper cam 210 is rotatably coupled, via turn piece 64, to dead bolt assembly 20 (see, e.g., FIG. 1).

Lower cam 212 includes a keyed opening 290, a key 292 and cam arms 294*a* and 294*b*. Keyed opening 290 includes a pair of flat sides that are sized and positioned to engage corresponding flats on hub 216, and key 292 is positioned to engage a corresponding groove in hub 216, such that when sleeve portion 224 of hub 216 is inserted into keyed opening 290, hub 216 and lower cam 212 will pivot as a unit about a pivot axis 296, which in turn passes through each of lower opening 220 of mounting plate 202 and lower opening 230 of cover plate 204.

FIG. 6 is a front view of chassis assembly 200 of FIG. 5 in an assembled state, with some components shown by phantom lines, depicting an unlocked position. For convenience and ease of understanding, a portion of cover plate 204 is shown broken away to expose springs 208*a* and 208*b*. As shown in FIG. 6, when assembled, mounting plate 202 is connected to cover plate 204 by bending assembly tabs 217*a*, 217*b*, 217*c* and 217*d* (see also FIG. 5) around corresponding portions of cover plate 204. A lever operator 298 is connected to hub 216, and in turn, will pivot as a unit about pivot axis 296, along with hub 216 and lower cam 212. Turn piece 64 is connected to upper cam 210, and in turn, will pivot as a unit about pivot axis 286. When chassis assembly 200 is installed on a door, turn piece 64 is coupled to dead bolt assembly 20, as described above in the previous embodiment (see, e.g., FIG. 1).

Referring again to FIGS. 5 and 6, springs 208*a*, 208*b* bias slide plate 206 in contact with lower cam 212. A rotation of lever operator 298 causes a corresponding rotation of lower cam 212 about pivot axis 296, which in turn causes a linear displacement, e.g., a vertical translation, of slide plate 206. Toggle 214, pivotally attached to slide plate 206, then engages and rotates the cam arm 282 of upper cam 210 from the locked position, wherein cam arm 282 is substantially horizontal, as shown in FIGS. 5 and 6, toward an unlocked position, wherein cam arm 282 is pivoted to a substantially vertical position. More specifically, for example, a counterclockwise rotation of lever operator 298 about pivot axis 296 results in a corresponding rotation of lower cam 212, which in turn causes the vertical displacement of slide plate 206 in direction 228 along the Y axis, with cam arm 294*b* of lower cam 212 lifting slide plate 206 via continuing engagement of cam arm 294*b* with lower cam arm engagement member 248*b* of slide plate 206. In turn, head portion 272 of toggle 214 engages cam arm 282 of upper cam 210, resulting in a rotation of upper cam 210 about pivot axis 286, thereby unlocking the dead bolt assembly 20, and retracting the dead bolt (see FIG. 1).

Dead bolt assembly 20 may then be returned to the locked position by a counterclockwise rotation of turn piece 64 about pivot axis 286, wherein cam arm 282 is again positioned substantially horizontal, as shown in FIGS. 5 and 6.

Figure 7:
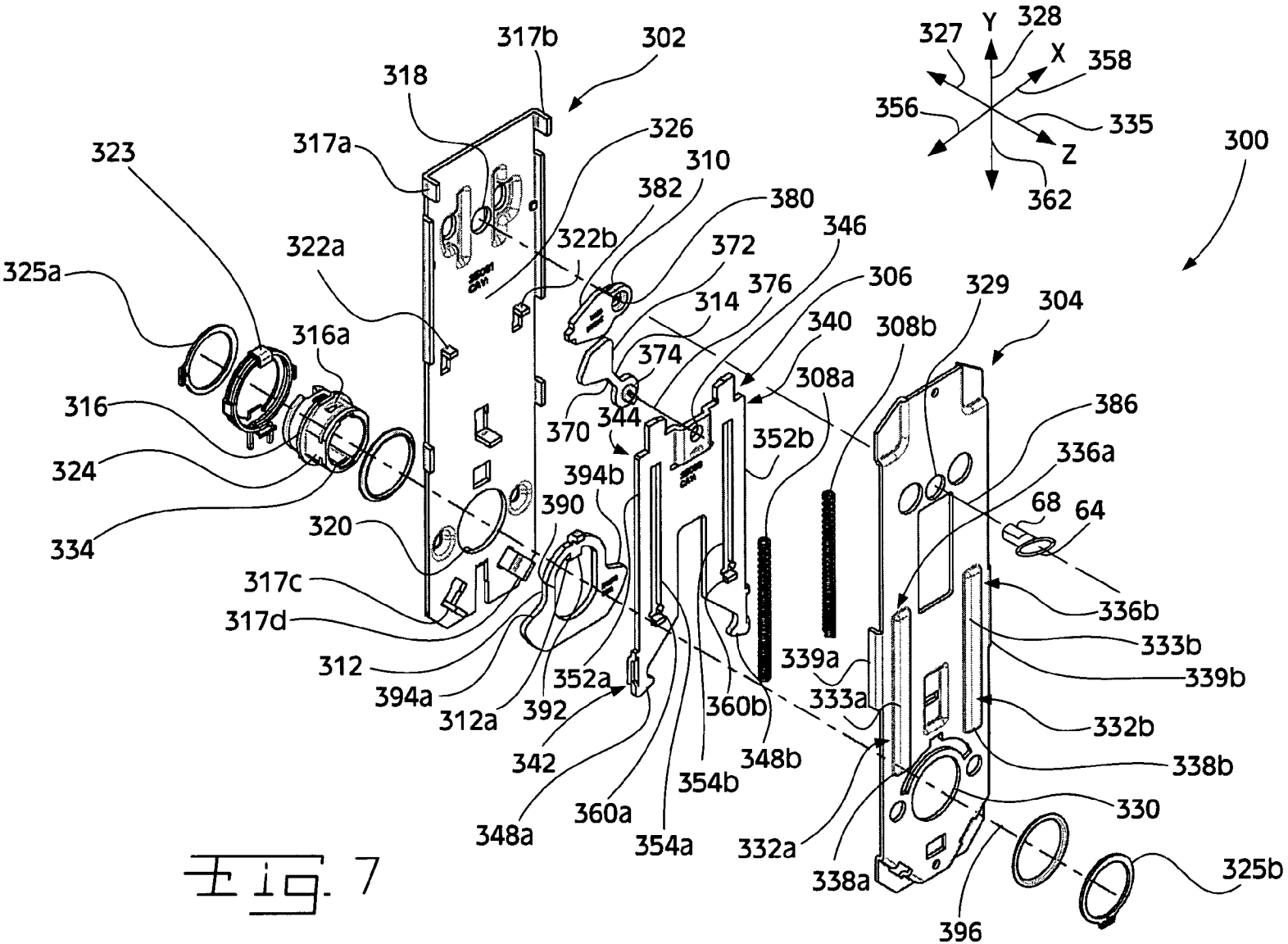
FIG. 7 is an exploded perspective view of a variant of the chassis assembly of FIGS. 5 and 6.

FIG. 7 is a variant of the embodiment of FIGS. 5 and 6, and operates in substantially the same manner as the embodiment described above with respect to FIGS. 5 and 6.

Referring to FIG. 7, there is shown an exploded perspective view of a chassis assembly 300. Chassis assembly 300 includes a mounting plate 302, a cover plate 304, a slide plate 306, springs 308*a* and 308*b*, an upper cam 310, a lower cam 312, a toggle 314 and a hub 316. Springs 308*a*, 308*b* may be, for example, coil springs, i.e., compression springs.

An operator, e.g., interior operator 66 or operator 298, such as a lever or knob, is inserted into and connected to hub 316.

Mounting plate 302 includes assembly tabs 317*a*, 317*b*, 317*c* and 317*d*, an upper opening 318, a lower opening 320, and upper spring engaging tabs 322*a* and 322*b*. Upper opening 318 is sized to receive drive member 68 of turn piece 64. In order to reduce the occurrence of misalignment of door hardware during installation, turn piece 64 is floating with respect to the escutcheon (not shown), as opposed to being attached to the escutcheon, and is directly connected to upper cam 310, thereby compensating for any such misalignment.

A torsion spring assembly 323 is provided to return hub 316 to a normal position after rotation about pivot axis 396. Lower opening 320 is sized to receive a sleeve portion 324 of hub 316. Snap ring 325*a* mounts torsion spring assembly 323 to hub 316, and snap ring 325*b* retains hub 316 in lower openings 320, 330. A plate surface 326 of mounting plate 302 serves to restrain lateral motion of springs 308*a*, 308*b* in direction 327. Spring engaging tabs 322*a* and 322*b* restrain springs 308*a* and 308*b* from upward movement in direction 328.

Cover plate 304 includes an upper opening 329, a lower opening 330, and spring retainer channels 332*a* and 332*b*. Upper opening 329 is sized to receive drive member 68 of turn piece 64. Lower opening 330 is sized to receive a lip portion 334 of hub 316. Spring retainer channels 332*a* and 332*b* are formed as concave recessed regions, e.g., elongated cavities, in cover plate 304 defined by recessed concave walls 333*a* and 333*b*, which restrain lateral motion of springs 308*a*, 308*b* in direction 335. Spring retainer channels 332*a* and 332*b* respectively include upper ends 336*a* and 336*b*, where tabs 322*a* and 322*b* of mounting plate 302 are received, respectively. Spring retainer channels 332*a* and 332*b* also respectively include lower ends 338*a* and 338*b*. Cover plate 304 further includes a pair of slide plate retention walls 339*a* and 339*b* that are horizontally spaced along the X axis, and which provide guide surfaces for slide plate 306 parallel to the Y axis.

Slide plate 306 has a first end 340, a second end 342, and an interior region 344 located between first end 340 and second end 342. Located at first end 340 of slide plate 306 is a pivot hole 346. A pair of lower cam arm engagement members 348*a* and 348*b* is located at second end 342 of slide plate 306.

Slide plate 306 includes a pair of guide rails 352*a*, 352*b* that are horizontally spaced, i.e., spaced in the X axis directions, and vertically extending, i.e., extending in the Y axis directions. Guide rails 352*a*, 352*b* are positioned between slide plate retention walls 339*a* and 339*b* of cover plate 304. Interior region 344 includes a pair of horizontally spaced, and vertically extending, spring retention slots 354*a* and 354*b*. Spring retention slots 354*a* and 354*b* restrain movement of springs 308*a*, 308*b* in directions 356 and 358, i.e., in the X axis directions. Located at a lower extreme of each of spring retention slots 354*a* and 354*b* is a spring support ledge 360*a* and 360*b*, respectively, for restraining springs 308*a* and 308*b* in direction 362 along the Y axis.

Toggle 314 includes an elongate portion 370, a head portion 372 and a pivot shaft 374 having a pivot axis 376. Pivot shaft 374 is received in pivot hole 346 of slide plate 306, such that pivot axis 376 passes through the center of pivot hole 346. Accordingly, toggle 314 pivots about pivot axis 376 at first end 340 of slide plate 306. Toggle 314, which is pivotably coupled to slide plate 306, may be easily rotated from left to right in order to switch chassis assembly 300 from a left hand door to a right hand door configuration, or vice versa. A simple tool, such as a flat blade screwdriver, may be inserted into a slot 378 (see FIG. 8) on the base, e.g., pivot shaft 374, of toggle 314 to rotate toggle 314 from left to right or vice versa. This feature is especially useful when dead bolt assembly 20 requires more than 90 degree rotation to fully retract or fully throw dead bolt 20*a*.

Upper cam 310 includes a keyed opening 380 and a cam arm 382. Keyed opening 380 includes a pair of flat sides that are sized and positioned to engage corresponding flats on drive member 68 of turn piece 64, such that when drive member 68 is inserted into keyed opening 380, turn piece 64 and upper cam 310 will pivot as a unit about a pivot axis 386, which in turn passes through each of upper opening 318 of mounting plate 302 and upper opening 329 of cover plate 304. Upper cam 310 is rotatably coupled, via turn piece 64, to dead bolt assembly 20 (see, e.g., FIG. 1).

Lower cam 312 includes a keyed opening 390, a key 392 and cam arms 394*a* and 394*b*. Keyed opening 390 includes a pair of flat sides that are sized and positioned to engage corresponding flats on hub 316, and key 392 is positioned to engage a corresponding groove in hub 316, such that when sleeve portion 324 of hub 316 is inserted into keyed opening 390, hub 316 and lower cam 312 will pivot as a unit about a pivot axis 396, which in turn passes through each of lower opening 320 of mounting plate 302 and lower opening 330 of cover plate 304.

When assembled, mounting plate 302 is connected to cover plate 304 by bending assembly tabs 317*a*, 317*b*, 317*c* and 317*d* around corresponding portions of cover plate 304. A lever operator, such as lever operator 298 of FIG. 6, is connected to hub 316, and in turn, will pivot as a unit about pivot axis 396, along with hub 316 and lower cam 312. Turn piece 64 is connected to upper cam 310, and in turn, will pivot as a unit about pivot axis 386. When chassis assembly 300 is installed on a door, turn piece 64 is coupled to dead bolt assembly 20, as described above in the previous embodiment (see, e.g., FIG. 1).

Interior operator 66 (see FIG. 1) or operator 298 (see FIG. 8), such as levers or knobs, may be easily removed, rotated 180 degrees, and reinstalled to switch chassis assembly 300 from a left hand door to a right hand door configuration, or vice versa. For example, this feature is especially beneficial when a non-symmetrical driver, such as a half-round spindle 70 of interior operator 66, is utilized to retract the spring-loaded latch bolt 22*a* to open the door. Interior operator 66 may be attached via mounting portion 114 to hub 316, and in turn lower cam 312, via a catch mechanism 312*a* that is built into lower cam 312 connected to slot 316*a* of hub 316. Catch mechanism 312*a* may be spring loaded by a compression spring at all times.

To remove interior operator 66, catch mechanism 312*a* of lower cam 312 is lifted using a common tool, such as a flat blade screwdriver, and then interior operator 66 is pulled in a direction along its axis of rotation. Half-round spindle 70 of interior operator 66 is permanently attached to interior operator 66, which allows the end user to orient the interior operator 66 properly according to the door handing. To attach interior operator 66 to chassis assembly 300, one simply pushes interior operator 66 until catch mechanism 312*a* of lower cam 312 connected to slot 316*a* of hub 316 detents back into a groove in mounting portion 114 of interior operator 66.

Figure 9:
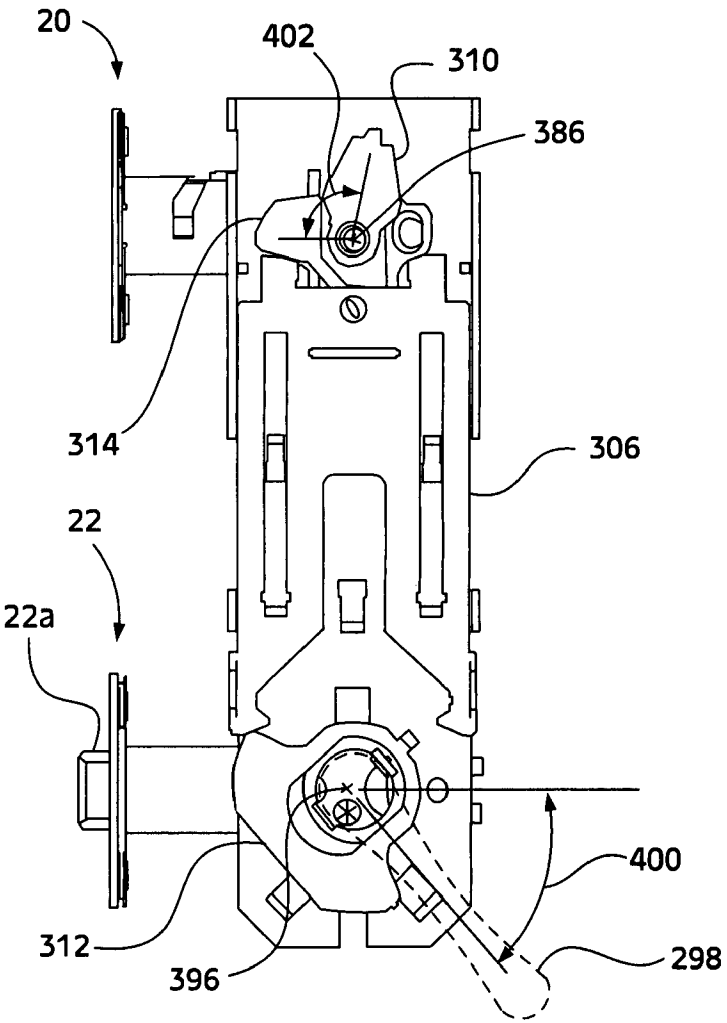
FIG. 9 shows the dead bolt fully retracted when the latch bolt is partially retracted, in accordance with one aspect of the present invention.
Figure 8:
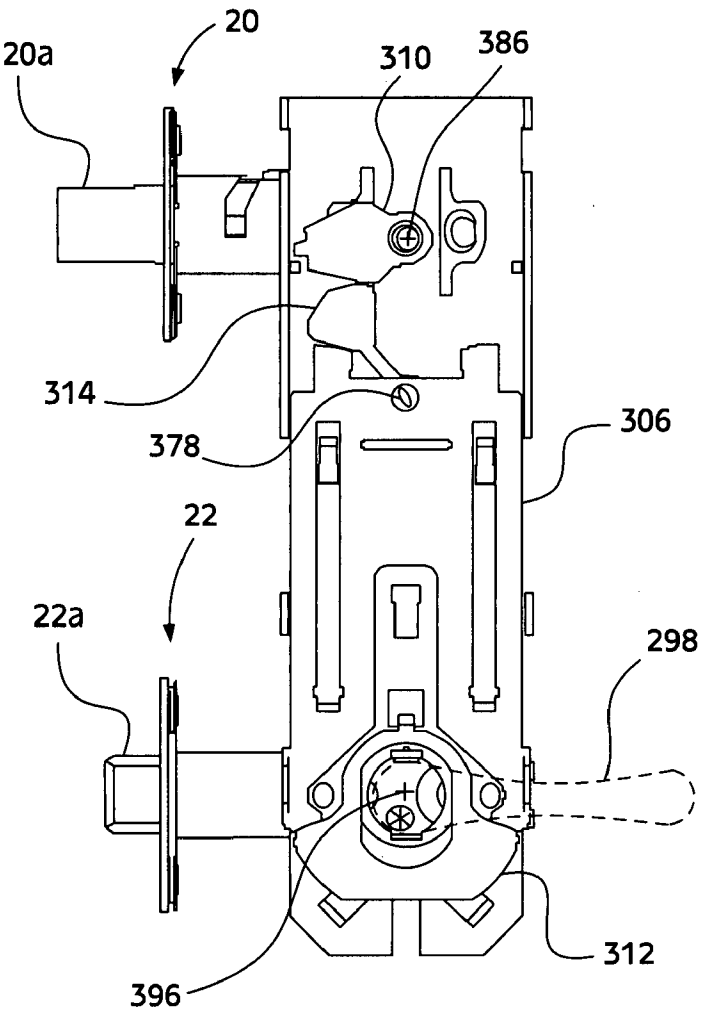
FIG. 8 shows a dead bolt of a dead bolt assembly and a latch bolt of a latch bolt assembly in the fully extended, i.e., locked, position.
Figure 10:
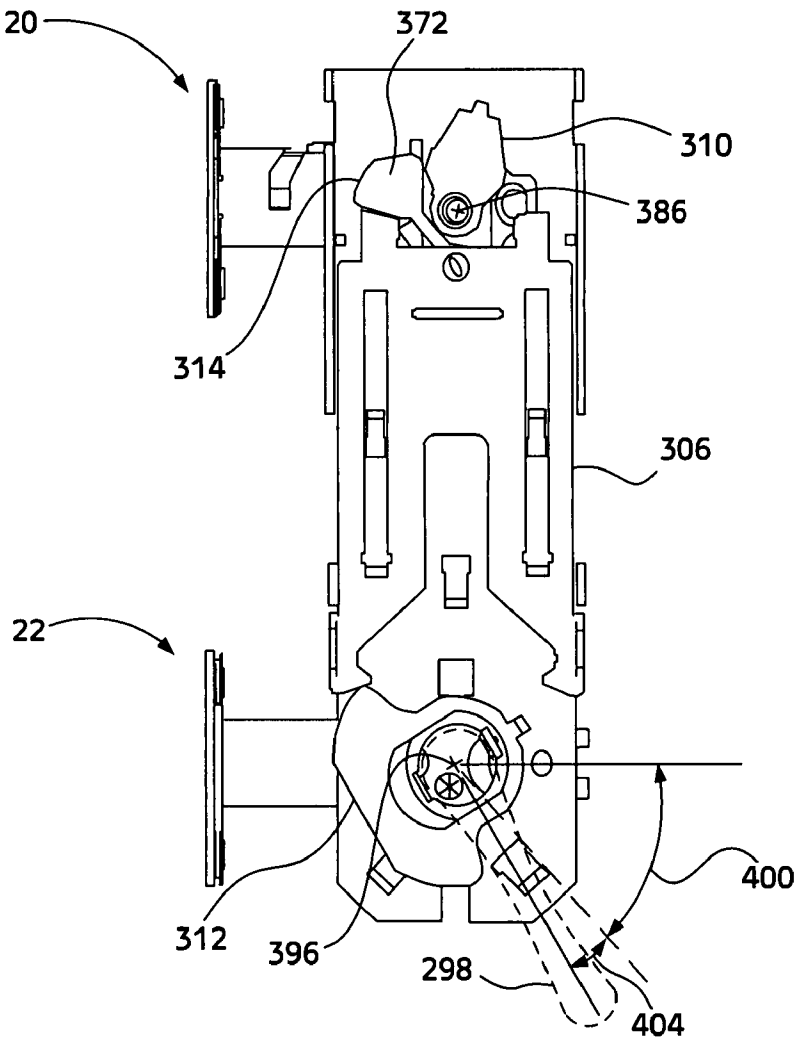
FIG. 10 shows both the latch bolt and the dead bolt fully retracted.

Referring now to FIGS. 8-10, there is shown various stages of operation of chassis assembly 300 with respect to corresponding positions of dead bolt assembly 20 and latch bolt assembly 22.

It has been determined that the timing of the retraction of the dead bolt and the latch bolt is very important in making sure that a chassis assembly, such as chassis assembly 300, will operate properly when a warped door condition exist. Such a warped door condition could be caused, for example, by door warpage, or heavy weatherstripping, misalignment of door to the jamb, etc., which all contribute to added friction to the dead bolt and/or latch bolt. For example, the maximum amount of rotation of the handle, such as lever operator 298, is limited by the maximum travel of the latch bolt of the latch bolt assembly. Thus, if the latch bolt is fully retracted before the dead bolt is fully retracted, then the user can not turn the handle any further, which causes the dead bolt to stay projected, which in turn prevents the door from being opened.

In accordance with another aspect of the present invention, dead bolt 20*a* (i.e., the upper latch) of dead bolt assembly 20 is fully retracted first, ahead of latch bolt 22*a* (i.e., the lower latch) of latch bolt assembly 22. This is achieved by the configuration and arrangement of, for example, lower cam 312, slide plate 306, toggle 314 and upper cam 310.

As shown in FIG. 8, dead bolt 20*a* of dead bolt assembly 20 and latch bolt 22*a* of latch bolt assembly 22 are in the fully extended, i.e., locked, position.

As shown in FIG. 9, as lever operator 298, and in turn lower cam 312, is rotated around pivot axis 396 by an angle 400 of about 40 to 50 degrees, latch bolt 22*a* of latch bolt assembly 22 becomes partially retracted. However, this rotation of lower cam 312 around pivot axis 396 by angle 400 of about 40 to 50 degrees results in a linear displacement, e.g., an upward movement, of slide plate 306 and toggle 314, which in turn results in a rotation of upper cam 310 about pivot axis 386 by an angle 402 of about 90 to 100 degrees, thereby fully retracting dead bolt 20*a* of dead bolt assembly 20.

As shown in FIG. 10, after an additional rotation of lower cam 312 around pivot axis 396 by an angle 404 of about 10 to 20 degrees, latch bolt 22*a* of latch bolt assembly 22 is fully retracted as well. In particular, the present configuration permits further rotation of lower cam 312 around pivot axis 396, since head portion 372 of toggle 314 is permitted to continue movement past upper cam 310 without further rotation of upper cam 310, and in turn, without further movement of dead bolt 20*a*.

While this invention has been described with respect to exemplary embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An interconnected chassis for a lock set, comprising:

a mounting plate including a spring engaging tab;

a cover plate including a recessed spring retention wall;

a lower cam having a lower pivot axis passing through said mounting plate and said cover plate;

an upper cam having an upper pivot axis passing through said mounting plate and said cover plate;

a slide plate positioned between said mounting plate and said cover plate, said slide plate having a spring retention slot and a spring support ledge, said slide plate including a first end having a pivot feature and a second end having a lower cam engagement member for engaging said lower cam;

a spring positioned in said spring retention slot of said slide plate and in said recessed spring retention wall of said cover plate, and between said spring engaging tab of said mounting plate and said spring support ledge of said slide plate; and a toggle pivotably coupled to said slide plate by said pivot feature, said toggle having a head portion positioned to engage said upper cam.

2. The interconnected chassis of claim 1, wherein a rotation of said lower cam about said lower pivot axis results in a displacement of said slide plate, said displacement of said slide plate causing said head portion of said toggle to engage said upper cam, resulting in a rotation of said upper cam about said upper pivot axis.

3. The interconnected chassis of claim 1, further comprising:

a turn piece directly connected to said upper cam without connection to an escutcheon; and a dead bolt assembly coupled to said upper cam.

4. The interconnected chassis of claim 1, further comprising:

a turn piece coupled to said upper cam;

a dead bolt assembly coupled to said upper cam; and an operator coupled to said lower cam, wherein a rotation of said operator results in a linear displacement of said slide plate, thereby moving said toggle to engage and rotate said upper cam to unlock said dead bolt assembly.

5. The interconnected chassis of claim 4, wherein said operator includes a mounting portion that is connected to a hub via said lower cam, said lower cam including a catch mechanism that releasably engages said mounting portion of said operator.

6. The interconnected chassis of claim 1, wherein said recessed spring retention wall defines an elongated cavity in said cover plate.

7. The interconnected chassis of claim 1, further comprising:

a dead bolt assembly coupled to said upper cam, said dead bolt assembly having a dead bolt;

a latch bolt assembly coupled to said lower cam, said latch bolt assembly having a latch bolt; and an operator coupled to said lower cam, wherein said lower cam, said slide plate, said toggle and said upper cam are configured and arranged so that a rotation of said operator results in a linear displacement of said slide plate to move said toggle to engage and rotate said upper cam to move said dead bolt to a fully retracted position prior to said latch bolt being fully retracted.

8. An interconnected chassis for a lock set, comprising:

a mounting plate including a first spring engaging tab and a second spring engaging tab;

a cover plate including a first recessed spring retention wall and a second recessed spring retention wall;

a lower cam having a lower pivot axis passing through said mounting plate and said cover plate;

an upper cam having an upper pivot axis passing through said mounting plate and said cover plate;

a slide plate positioned between said mounting plate and said cover plate, said slide plate having a first spring retention slot, a second spring retention slot, a first spring support ledge and a second spring support ledge, said slide plate including a first end having a pivot feature and a second end having at least one lower cam engagement member for engaging said lower cam;

a first spring positioned in said first spring retention slot of said slide plate and in said first recessed spring retention wall of said cover plate, and positioned between said first spring engaging tab of said mounting plate and said first spring support ledge of said slide plate;

a second spring positioned in said second spring retention slot of said slide plate and in said second recessed spring retention wall of said cover plate, and positioned between said second spring engaging tab of said mounting plate and said second spring support ledge of said slide plate; and a toggle pivotably coupled to said slide plate by said pivot feature, said toggle having a head portion positioned to engage said upper cam.

9. The interconnected chassis of claim 8, wherein a rotation of said lower cam about said lower pivot axis results in a displacement of said slide plate, said displacement of said slide plate causing said head portion of said toggle to engage said upper cam, resulting in a rotation of said upper cam about said upper pivot axis.

10. The interconnected chassis of claim 8, further comprising:

a dead bolt assembly; and a turn piece coupled to said upper cam and said dead bolt assembly.

11. The interconnected chassis of claim 10, further comprising an operator coupled to said lower cam, wherein a rotation of said operator results in a linear displacement of said slide plate, thereby moving said toggle to engage and rotate said upper cam to unlock said dead bolt assembly.

12. The interconnected chassis of claim 8, further comprising an operator coupled to said lower cam.

13. The interconnected chassis of claim 8, wherein said first recessed spring retention wall defines a first elongated cavity in said cover plate and wherein said second recessed spring retention wall defines a second elongated cavity in said cover plate.

14. The interconnected chassis of claim 8, further comprising:

a dead bolt assembly coupled to said upper cam, said dead bolt assembly having a dead bolt;

a latch bolt assembly coupled to said lower cam, said latch bolt assembly having a latch bolt; and an operator coupled to said lower cam, wherein said lower cam, said slide plate, said toggle and said upper cam are configured and arranged so that a rotation of said operator results in a linear displacement of said slide plate to move said toggle to engage and rotate said upper cam to move said dead bolt to a fully retracted position prior to said latch bolt being fully retracted.

15. A method for providing a lock set with an interconnected chassis, comprising the steps of:

configuring a mounting plate for attachment to a door, said mounting plate having a spring engaging tab;

configuring a cover plate including a recessed spring retention wall;

associating a first cam, having a first pivot axis, with said mounting plate and said cover plate;

associating a second cam, having a second pivot axis, with said mounting plate and said cover plate, said first cam and said second cam being spaced apart;

positioning a slide plate between said mounting plate and said cover plate, said slide plate having a spring retention slot and a spring support ledge, said slide plate including a first end having a pivot feature and a second end having a lower cam engaging member for engaging said lower cam;

positioning a compression spring in said spring retention slot of said slide plate and in said recessed spring retention wall of said cover plate, and between said spring engaging tab of said mounting plate and said spring support ledge of said slide plate; and pivotably coupling a toggle to said slide plate by said pivot feature, said toggle having a head portion positioned to engage said upper cam.

16. The method of claim 15, wherein a rotation of said lower cam about said lower rotational axis results in a displacement of said slide plate, said displacement of said slide plate causing said head portion of said toggle to engage said upper cam, resulting in a rotation of said upper cam about said upper pivot axis.

17. The method of claim 15, further comprising attaching an operator to said lower cam, wherein a rotation of said operator about said lower pivot axis results in a vertical translation of said slide plate causing said head portion of said toggle to engage said upper cam.

18. The method of claim 17, further comprising coupling a dead bolt assembly to said upper cam, and wherein said rotation of said operator results in a translation of said slide plate and said toggle, said toggle engaging said upper cam to unlock said dead bolt assembly.

* * * * *